US005092203A

United States Patent [19]

Mader et al.

[11] Patent Number: 5,092,203

[45] Date of Patent: Mar. 3, 1992

[54] WRENCH OPENINGS

[75] Inventors: William G. Mader, York; Peter Peppel, Nazareth, both of Pa.

[73] Assignee: Easco Hand Tools, Inc., Lancaster, Pa.

[21] Appl. No.: 690,077

[22] Filed: Apr. 23, 1991

[51] Int. Cl.[5] ..... B25B 13/02

[52] U.S. Cl. ..... 81/119; 81/186

[58] Field of Search ..... 81/119, 121.1, 186

[56] References Cited

U.S. PATENT DOCUMENTS 3,242,775 3/1966 Hinkle ..... 81/124.3

4,581,957 4/1986 Dossier ..... 81/121.1

*Primary Examiner*—James G. Smith

*Attorney, Agent, or Firm*—Leonard Bloom

[57] ABSTRACT

A wrench, such as a socket, for a torquing device, such as a ratchet wrench for cooperating with a fastener, such as a nut or bolt. The fastener has plurality of faces that join each other at respective edges. The fastener also has radii that are measured from the center of the fastener to the respective faces thereof, a first radius from the center of the fastener which is normal to the face of the fastener; a second radius at an angle of approximately 15° from the first radius and a third radius at an angle of approximately 15° plus a flank angle from the first radius. The coupling element includes a plurality of adjoining surfaces. Each surface includes an adjoining flank section at each end thereof that is angled with respect to the surface in a direction away from the corner of the fastener, the angle being the flank angle. The surface at the respective flank section thereof always engages the respective face of the fastener at a point thereon between the intercepting of the second radius and the intercepting of the third radius which point of intercepting is spaced from the respective adjacent corner of the fastener by an optimum distance.

12 Claims, 10 Drawing Sheets

WRENCH OPENINGS

CROSS REFERENCE TO RELATED APPLICATION

This application is a continuation-in-part of copending application Ser. No. 438,060 filed on Nov. 20, 1989, now abandoned the disclosure of which is incorporated by reference herein in its entirety.

FIELD OF THE INVENTION

The present invention relates to wrench openings and particular, to openings for coupling polygonal shaped fasteners, such as nuts, bolts and the like with a tool, such as a wrench, for applying torque to, and turning, the fastener.

BACKGROUND OF THE INVENTION

Torquing devices, such as wrenches, include coupling elements (torque adaptors) for coupling the device to a fastener, such as a nut or bolt, so that torque may be applied to the device for turning the fastener. The coupling element (coupler) may either be separable from the device, such as a socket that is separable from the remainder of a ratchet wrench, or it may be integral with the device, such as a closed or open ended box wrench. The term wrench is used herein to represent all types of coupling devices including the conventional socket, the closed end wrench, the open ended wrench and the box wrench.

The coupling elements have openings, such as cavities, formed therein which engage flat surfaces of polygonal shaped fasteners, such as nuts or bolts, to be turned thereby. Customarily, these wrench openings include a plurality of flat engagement surfaces, which are arranged in diametrically opposed parallel pairs. These surfaces are disposed, so as to parallel the shape of the fastener.

Standard dimensions and tolerances have been recognized for such wrench openings. These standards establish the permissible maximum and minimum clearances between the fastener and the wrench for each standard size, as well as the corresponding maximum and minimum angles of "free swing" of the wrench which can occur before contact is made between the flat surfaces of the wrench opening and those of the fastener. Obviously, the maximum permissible clearance and "free swing" will exist when a wrench, having the largest acceptable diametrical distance across the opening, is used with a fastener which has the smallest acceptable dimension diametrically across the flat surfaces thereof. Conversely, the minimum permissible clearance and "free swing" will exist when a wrench, having the smallest acceptable distance diametrically across the opening, is used on a fastener, which has the largest acceptable dimension diametrically across the flat surfaces thereof.

Due to this necessary range of permissible clearances, when an ordinary wrench is applied to a fastener and is rotated about its axis, the theoretical optimum contact between the flat surfaces of the fastener and the flat engagement surfaces of the wrench is not obtained. As a result, the contact between the wrench and the fastener occurs at or near at least a pair of diametrically opposite corners of the fastener (defined by the junction between adjoining, intersecting flat surfaces of the fastener). The net result is that theoretical line contact is not achieved, the torque transmission between the wrench and fastener is insufficient, slippage results, and the fastener is marred or damaged. Industry standards have been established to prevent initial contact between the socket and the fastener at the corner of the fastener.

Line contact frequently results in the build-up of such pressures that, especially at or near the maximum clearance, the corners of the fastener become mutilated, rounded-off and/or otherwise deformed. Accordingly, the torquing pressure that is, under normal conditions, already concentrated on a very small and easily distorted area of the fastener (the corners), is amplified along the line of contact, further, because of the wedging action between the engagement surfaces of the wrench opening and the corners of the fasteners, high spreading or bursting forces are built up in the head of the wrench which can crack, break and/or otherwise deform the wrench, especially when ordinary open end wrenches are involved. Such a condition creates a potential accident hazard, should the wrench suddenly slip around the corners under torque (due to deformation of the fastener and/or wrench).

In an attempt to overcome the above-mentioned problems, it has been proposed to provide wrench openings that engage the flat surfaces of the fastener in a surface-to-surface engagement while still providing the looseness and oscillary type play necessary, so that some "free swing" is still provided between the wrench and the fastener. To achieve this goal, it has also been proposed to equip the flat engagement surfaces of the wrench openings with angularly oriented planar engagement surface portions, whose angularity is selected in an attempt to provide the surface-to-surface engagement with the fastener when the mean tolerance spacing is present.

In U.S. Pat. No. 3,242,775 issued to Hinkle, a wrench is disclosed having an opening wherein each of the engagement surfaces of a wrench opening includes a central planar surface that is bordered on both ends by respective angulated surfaces. These angulated surfaces are also planar and are arranged and disposed relative to each other and to the planar surface at apices to form inwardly disposed apices at 6½° angles. The end of each angulated surface not forming the apices borders on one end of a respective groove having a curvature. The combination of the planar surface, an adjacent angulated surface and the apice formed therebetween, engages the tool to be removed.

In U.S. Pat. No. 3,495,485 issued to Knudsen et al, a socket is disclosed that has a geometric peripheral configuration of pairs of oppositely-inclined engaging surfaces for engaging and driving the tool, along with, and positioned between, concavities for providing complete tool corner disengagement. The angularity of the pairs of oppositely-inclined engaging surface are within a limited plus or minus range of 144° outside and 216° inside. The centers of the concavities alternating with the apexes formed at the junction of each pair of oppositely-inclined formed surfaces are symmetrically indexed on substantially 15° angle emanating from the socket axis.

Other references which disclose wrench openings having angularly oriented planar engagement surface portions include U.S. Pat. Nos. 3,466,956 issued to Bowers, 3,903,764 issued to Andersen, 3,908,488 issued to Andersen and 4,512,220 issued to Barnhill, III, et al.

To further attempt to minimize the damage that can result from contacting the fastener near the corners thereof, it has also bee proposed to provide the opening of the wrench with convex or curved bearing surfaces that contact the flat surfaces of the fastener, so that surface-to-surface engagement, as opposed to line contact, between the fastener and the wrench is provided.

U.S. Pat. No. 4,581,957 issued to Dossier discloses a wrench opening having inwardly-convexed curved bearing surfaces disposed at either end of a straight surface. The curved bearing surfaces are the sole surfaces thereof that engage the flat surfaces of a tool desired to be removed thereby the curvature of these bearing surfaces is defined as being relative to the value of X by the formula:

$$\frac{X}{R + a/2} < \text{Tan } 15^\circ$$

One end of each of the bearing surfaces is adjacent to a respective groove while the other end of each bearing surface is adjacent to a respective planar surface. Neither these grooves nor the planar surfaces engage the tool to be turned.

U.S. Pat. No. 4,598,616 issued to Colvin, discloses wrench openings that have symmetrical inwardly-convexed curved bearing surfaces which engage the flat surfaces of the tool to be removed. The surfaces have curvatures including central portions. Each of the central portions of the engagement surfaces are spaced from a central axis by a radius $R_1$. The curvatures of these surfaces have a radius of $R_2$. $R_1$ is defined as being from 0.06 $R_2$ to 0.40 $R_2$.

While aiding in alleviating the problems associated with line contact by providing surface-to-surface engagement in each of these references, contact still occurs between the engagement surfaces of the wrench opening and the flat surfaces of the fastener at or near the corners of said fastener. Some of the prior art is effective for a few sizes of sockets, but it is not consistent throughout the rang of sizes needed for all fasteners. Hinkle, for example, discloses a flank angle which does not vary with different sizes of wrenches or sockets. However, since 1965, no one has recognized that a constant flank angle produces damage to fasteners with certain sizes of wrenches or sockets and tolerance accumulations in manufacture of both sockets and fasteners. Despite this reference of long standing, such contact can still result in damage and/or deformation of the corners of the fastener, as described above.

Thus, it can be seen that there remains a need for a coupling element for a wrench and/or a wrench which incorporates a coupling element that has an opening therein for receiving a fastener to be turned thereby, which coupling element includes bearing surfaces that contact the flat edges of the fastener at a location that is spaced far enough from the corners defined therebetween, so that damage and/or deformation of the corner of the fastener is minimized.

SUMMARY OF THE INVENTION

It is a primary object of the present invention to provide a coupling element for a wrench or the like and/or a wrench or the like that incorporates a coupling element that has an opening formed therein for applying torque to a fastener without bearing on the corners of the fastener's wrenching points.

It is still another object of the present invention to provide such a coupling element and/or wrench that, during torquing, contacts the fastener with a surface-to-surface engagement.

It is still further an object of the present invention to provide such a coupling element and/or wrench that closely resembles conventional coupling elements in appearance, so as to facilitate user acceptance thereof.

In accordance with the teachings of the present invention, there is disclosed a wrench cooperating with a fastener, wherein the fastener has a center and a plurality of faces joining each other at respective corners of the fastener. The fastener has a first radius extending from the center of the fastener to a point of intersection on the respective face normal to said face and has a second radius larger than the first radius, extending from the center of the fastener and intercepting the respective face of the fastener. The second radius is at an angle of approximately 15° from the first radius. A third radius extends from the center of the fastener to a point of interception on the respective face of the fastener. The third radius is larger than the second radius and is at an angle of approximately 15° plus flank angle from the first radius. The wrench comprises, in combination, a plurality of adjoining surfaces cooperating with the respective faces of the fastener. Each surface of the wrench includes a substantially-flat intermediate section having a pair of ends. Each surface of the wrench further includes an adjoining flank section at each end of the intermediate section. Each flank section is angled with respect to the intermediate section in a direction away from the fastener, thereby defining the flank angle between the flank and intermediate sections, respectively. The end of the intermediate section of each wrench surface at the respective flank section thereof has a point of engagement with the respective face of the fastener at a point on the face of the fastener which is substantially between the intersection of the second radius of the fastener and the intersection of the third radius of the fastener with the respective face thereof. This point of engagement is spaced from the respective adjacent corner of the fastener by an optimum distance, thereby assuring good torque engagement between the fastener and the wrench without marring the corners of the fastener.

In a preferred embodiment, a set of wrenches is provided sized to fit a range of fasteners. For a given range of fastener sizes, the flank angle decreases as the size of the fastener increases.

In yet another preferred embodiment, the flank angle is at least 0.5°.

In a further preferred embodiment, an arcuate relief is provided between respective flank sections at adjoining surfaces of the wrench element.

In an alternate embodiment, there is disclosed a wrench cooperating with a fastener, wherein the fastener has a center and a plurality of faces joining each other at respective corners of the fastener. The fastener has a first radius extending from the center of the fastener to a point of intersection on the respective face normal to said face and has a second radius, larger than the first radius, extending from the center of the fastener and intercepting the respective face. The second radius is at an angle of approximately 15° from the first radius. A third radius extends from the center of the fastener to a point of interception on the respective face of the fastener. The third radius is larger than the second radius and is at an angle of approximately 15° plus a flank angle from the first radius. The wrench comprises, in combination, a plurality of adjoining surfaces cooperating with the respective faces of the fastener. Each surface of the wrench has a pair of adjoining flank sections forming an edge portion on the wrench. Each flank section is angled with respect to the edge portion on the wrench in a direction away from the fastener, thereby defining the flank angle between the flank and edge portion, respectively. The edge portion of each wrench surface at the respective flank section thereof has a point of engagement with the respective face of the fastener at a point on the face of the fastener which is substantially between the intersection of the second radius of the fastener and the interception of the third radius of the fastener with the respective face thereof. This point of engagement is spaced from the respective adjacent corner of the fastener by an optimum distance, thereby assuring good torque engagement between the fastener and the wrench without marring the corners of the fastener.

In still a further embodiment, there is disclosed a wrench cooperation with a fastener, wherein the fastener has a plurality of faces joining each other at respective corners of the fastener. The wrench comprises, in combination, a plurality of adjoining surfaces cooperating with the respective faces of the fastener. Each surface of the wrench includes a substantially-flat intermediate section having a pair of ends. Each surface of the wrench further includes an adjoining flank section at each end of the intermediate section. Each flank section is angled with respect to the intermediate section in a direction away from the fastener, thereby defining a flank angle $\alpha$ between the flank and intermediate sections, respectively. The fastener has a minimum width and the wrench has a maximum width. The flank angle is defined by $$\alpha = \left[ \text{Arc Cos} \left( \frac{WF}{WS} \text{Cos } 15^\circ \right) \right] - 15^\circ$$

in which:

$\alpha$=the flank angle

WF=minimum fastener width

WS=maximum wrench width

These and other objects of the present invention will become apparent from a reading of the following specification, taken in conjunction with the enclosed drawings.

BRIEF DESCRIPTION OF THE DRAWINGS

FIG. 14A is a socket of the present invention disposed on the fastener.

FIG. 14B is a socket of the present invention initially engaging the fastener.

FIG. 14C is a socket of the present invention fully engaging the fastener.

FIG. 14D is a socket of the present invention engaging the fastener and moving with the fastener.

FIG. 15A is a socket of the present invention initially engaging the fastener.

FIG. 15B is a socket of the present invention fully engaging the fastener.

FIG. 15C is a socket of the present invention engaging the fastener an moving with the fastener.

DESCRIPTION OF PREFERRED EMBODIMENTS

Figure 1:
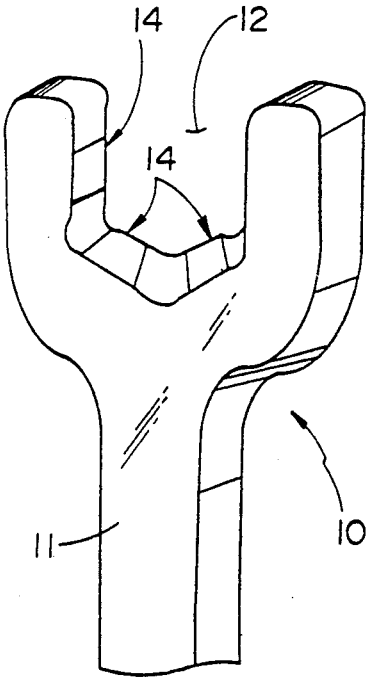
FIG. 1 is a perspective view of the open end wrench embodiment of the present invention.
Figure 2:
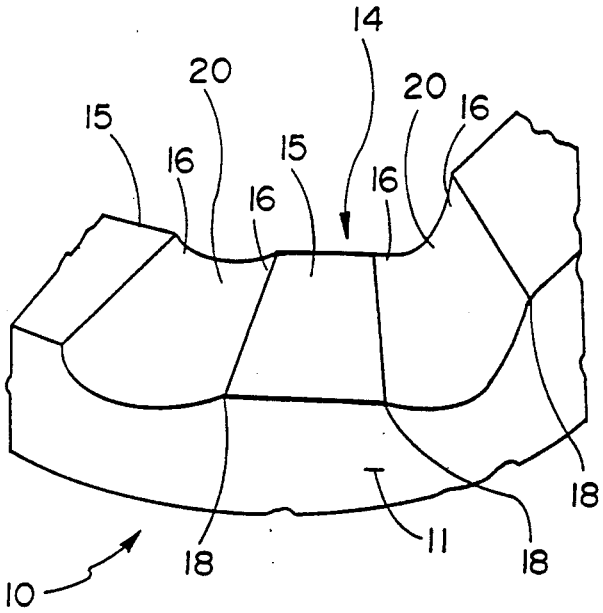
FIG. 2 is an enlarged view of the surface of the wrench of FIG. 1 showing the flat intermediate section, the adjoining flank section and the arcuate relief between the flank sections.

With reference now to the figures, a coupling element (coupler), in the form of a wrench 10 includes a unitary body 11 having a fastener opening 12 formed therein (in one end thereof) along a central axis 13 for removably receiving the fastener 2 therein, so as to permit the torquing thereof.

Wrench 10 is intended for use with a wrench, such as a ratchet wrench, or other similar apparatus for applying torque to a fastener 2. The fasteners 2 with which this wrench 10 is useful includes those fasteners 2 that have a plurality of substantially flat, planar faces 3 that join each other at respective corners (or edges) 4 of the fastener 2. These fasteners 2 also have a radius 25 that is measured from the center of the fastener 2 to its respective corners 4.

Opening 12 includes a plurality of adjoining engagement surfaces 14. Each of the surfaces 14 faces inwardly, towards the axis 13, thereby defining a closed shape that parallels the shape of the fastener 2 to be torqued. Each of the surfaces 14 has a pair of respective opposite ends.

The surfaces 14 are angled at the ends thereof (where the intermediate portions 15 are joined to the flank portions 16) with respect to the surface (or the intermediate portion 15 thereof) in a direction away from the fastener 2. In this manner, a respective flank angle $\alpha$ is defined between each of the surfaces 14 (or the intermediate portions 15 thereof) and the flank portions 16 adjacent thereto.

With reference now to FIGS. 4–8A, the opening 12 also includes connecting surfaces 20 that extend between the adjoining flank portions 16. Preferably, these connecting surfaces are in the form of arcuate reliefs that extend between respective flank portions of adjoining surfaces 14.

Figure 3:
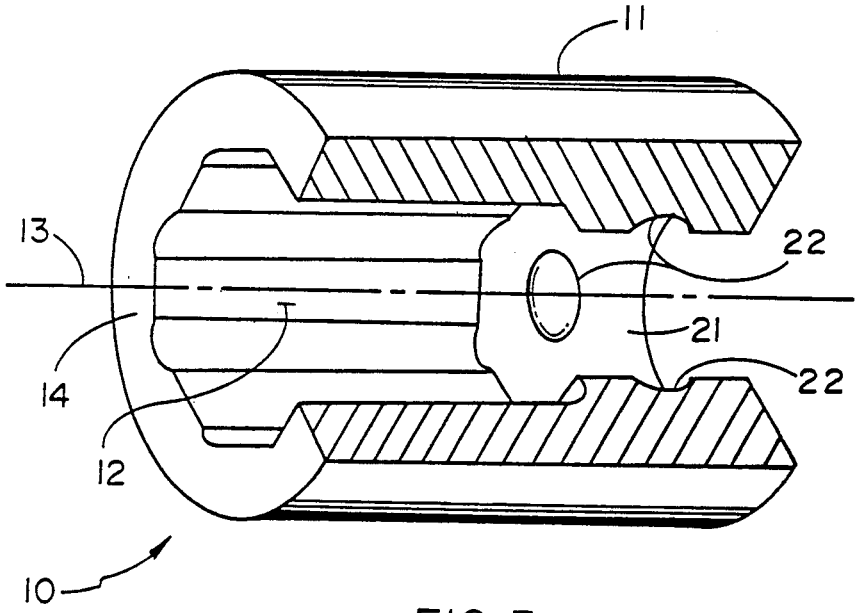
FIG. 3 is a perspective view in partial cross section of the socket embodiment of the present invention, for use in a ratchet wrench.
Figure 4:
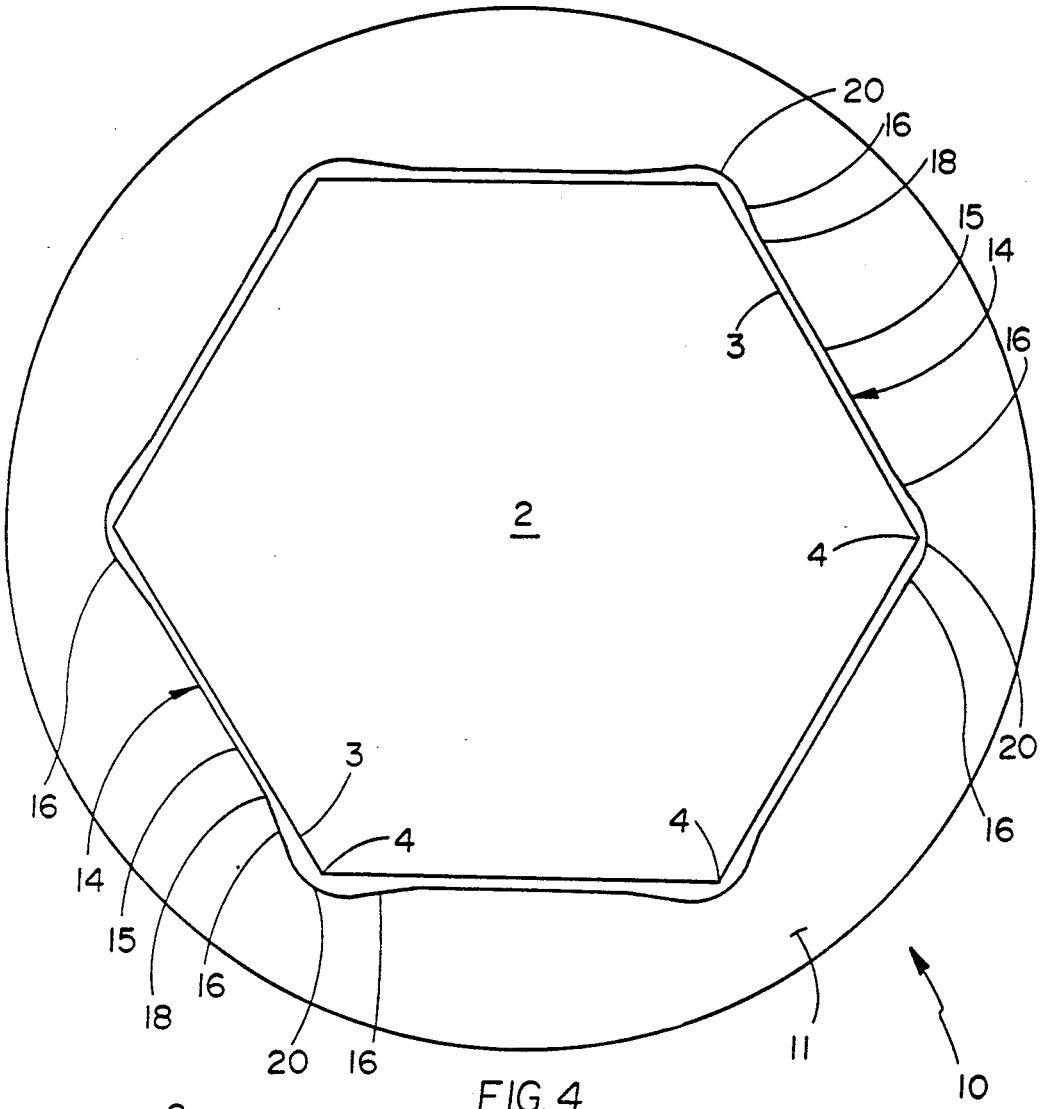
FIG. 4 is a top view of the socket embodiment of the present invention and a fastener, wherein the socket has a six-point opening.
Figure 4A:
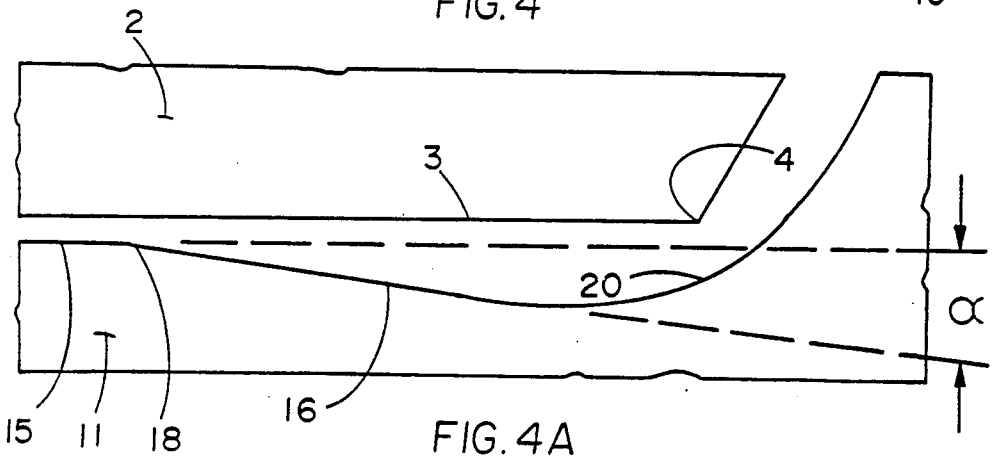
FIG. 4A is an enlarged view of the corner of the fastener of FIG. 4 in its relation to the socket of the present invention showing that the socket does not engage the corner of the fastener.
Figure 5:
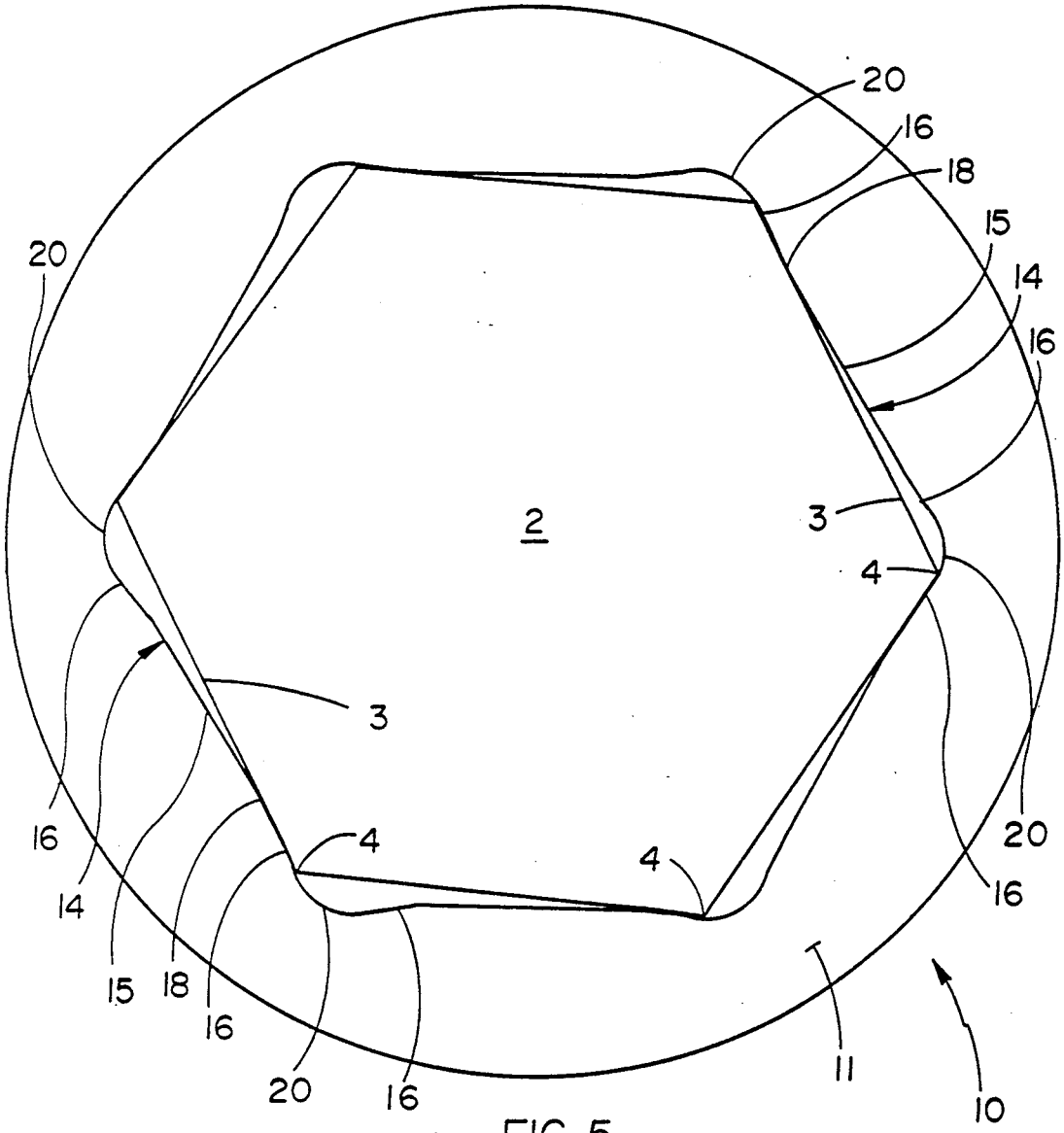
FIG. 5 is a view of FIG. 4 wherein the socket has been turned in a counter-clockwise direction to loosen the fastener.
Figure 5A:
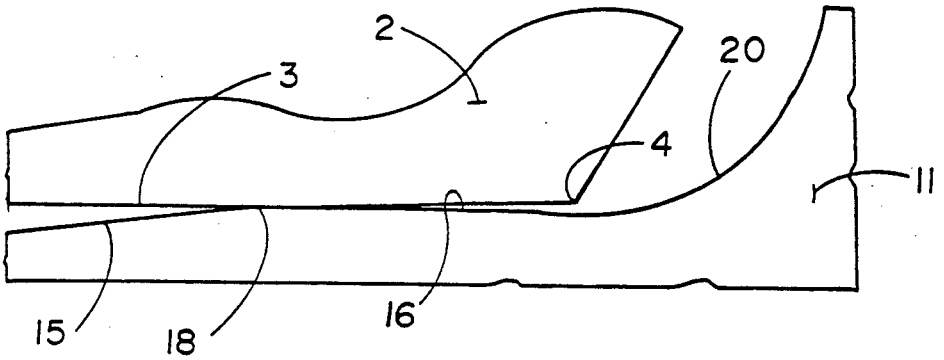
FIG. 5A is an enlarged view of the corner of the fastener of FIG. 5 in its relation to the socket of the present invention showing that the socket does not engage the corner of the fastener.
Figure 6:
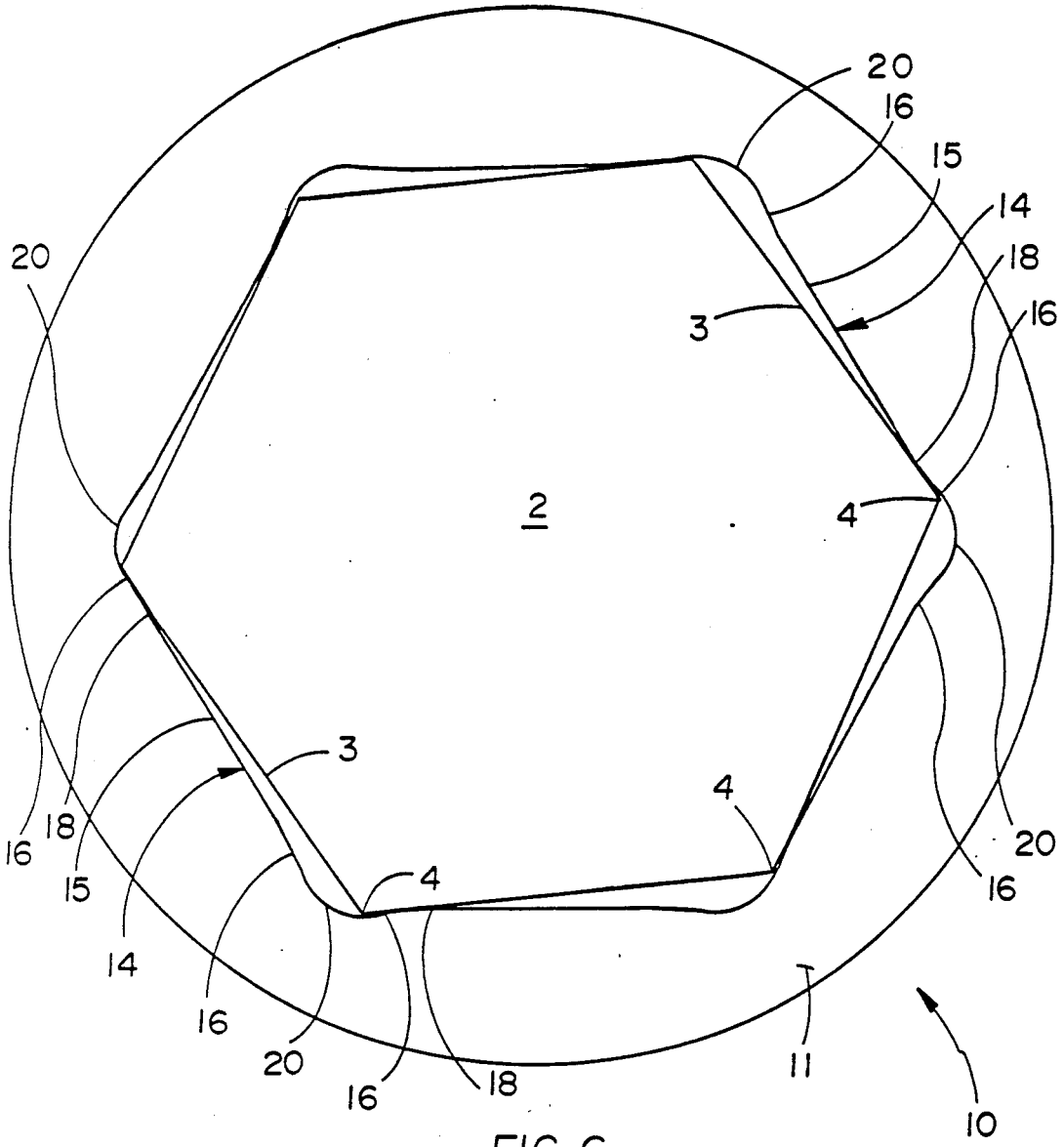
FIG. 6 is a view of FIG. 4 wherein the socket has been turned in a clockwise direction to tighten the fastener.
Figure 6A:
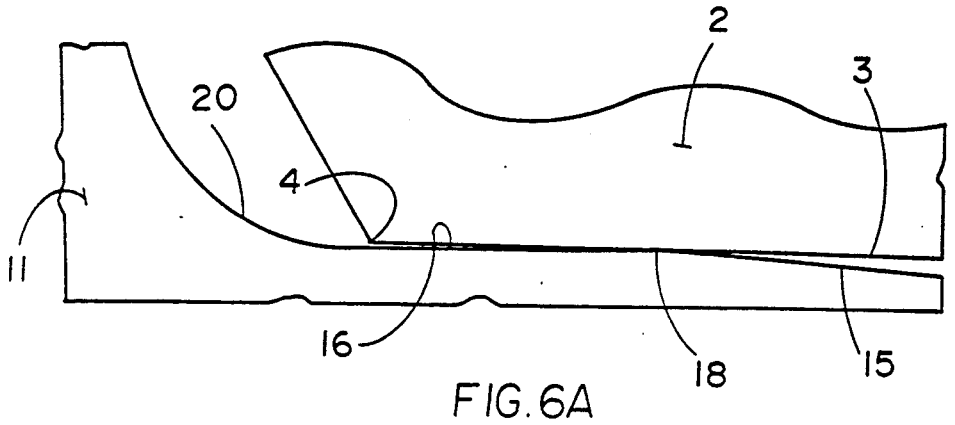
FIG. 6A is an enlarged view of the corner of the fastener of FIG. 6 in its relation to the socket of the present invention showing that the socket does not engage the corner of the fastener.
Figure 7:
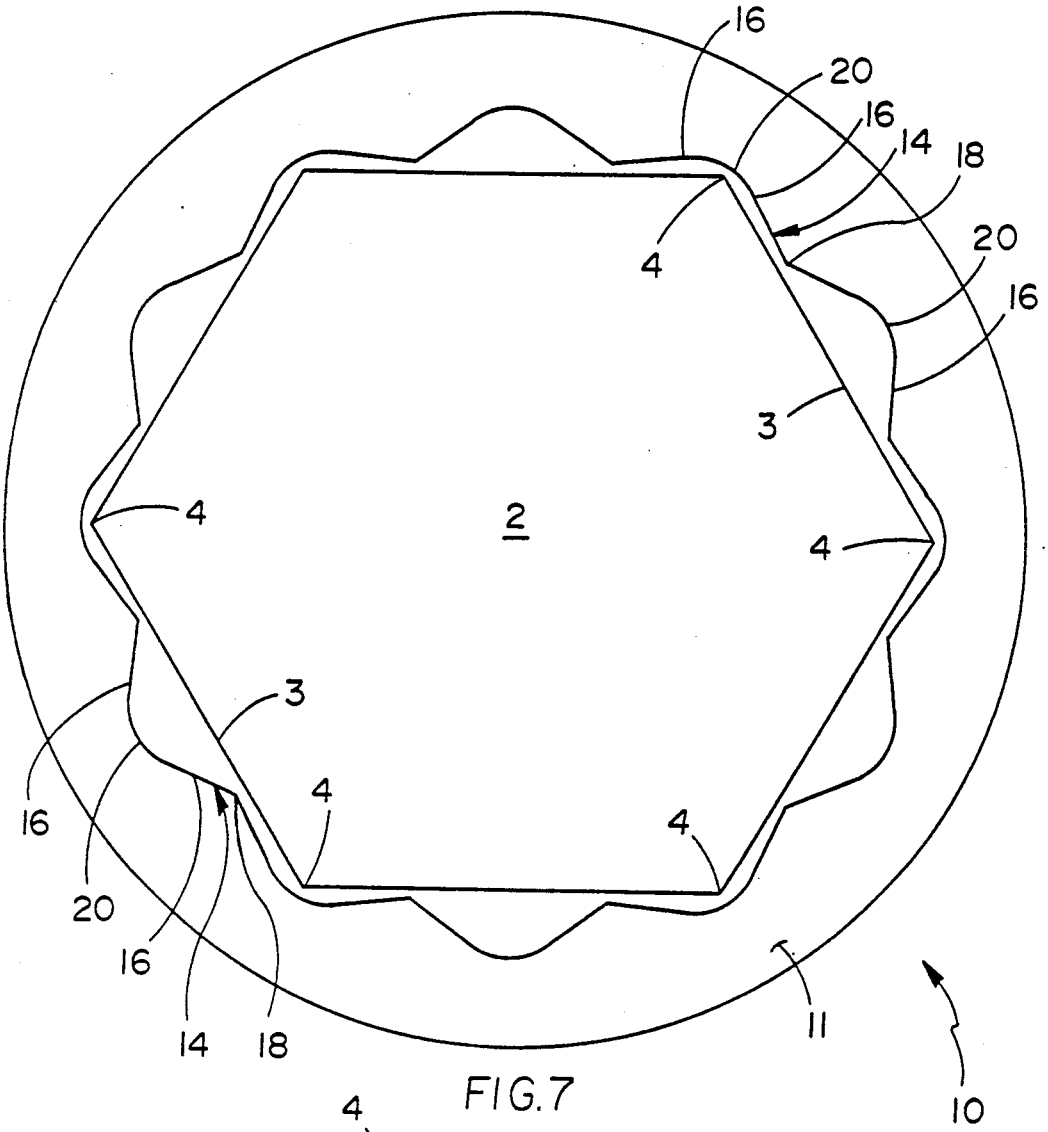
FIG. 7 is a top view of the socket embodiment of the present invention and a fastener wherein the socket has a twelve-point opening.
Figure 7A:
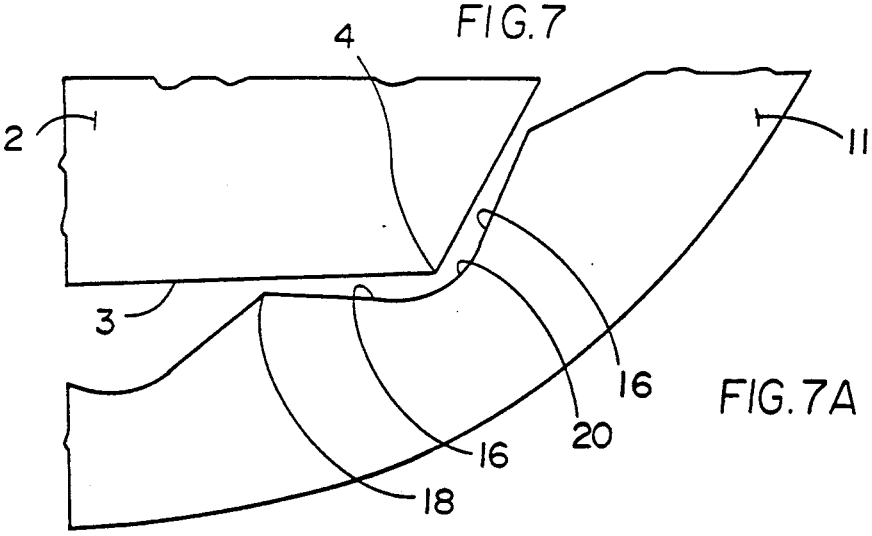
FIG. 7A is an enlarged view of the corner of the fastener of FIG. 7 in its relation to the socket of the present invention showing that the socket does not engage the corner of the fastener.
Figure 8:
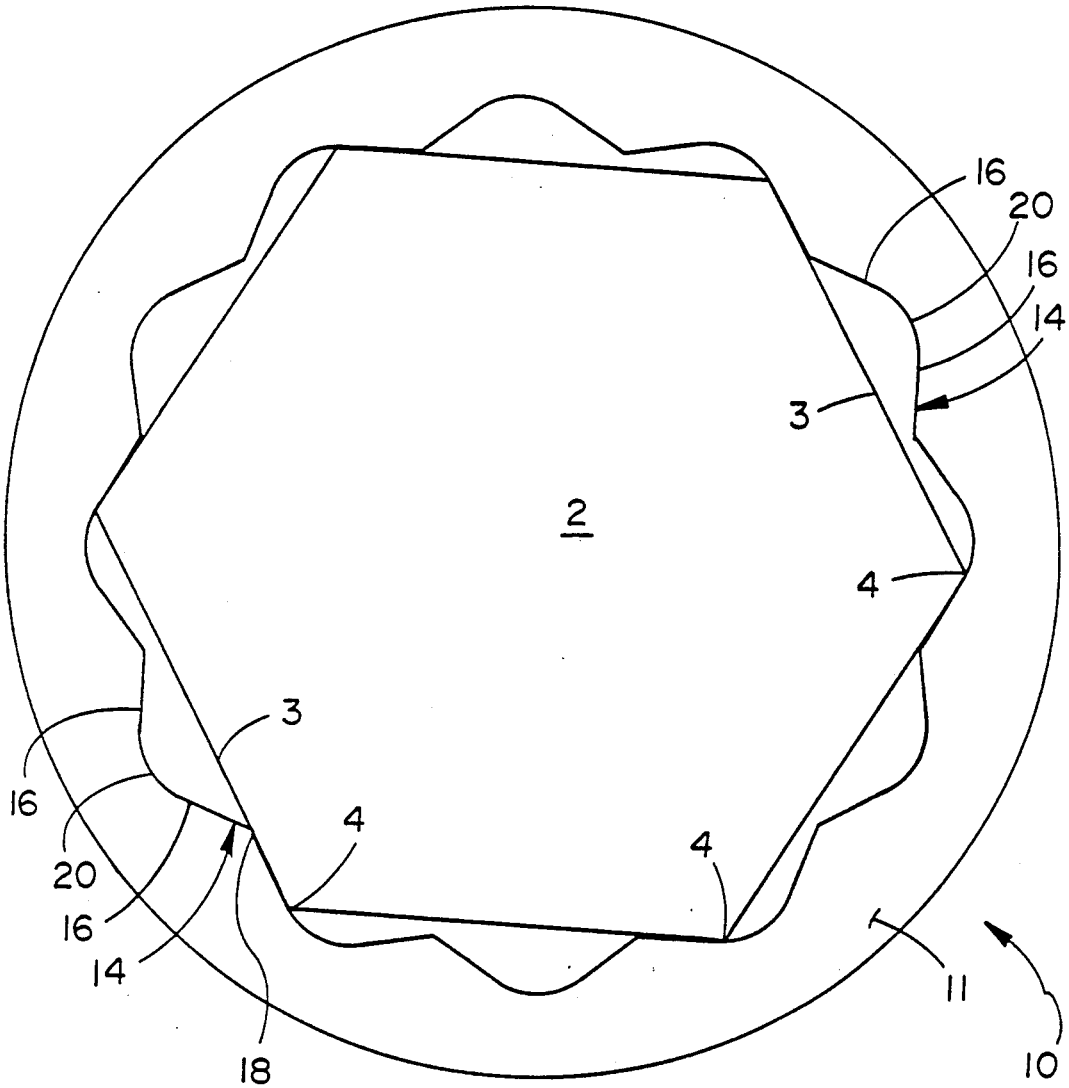
FIG. 8 is a view of FIG. 7 wherein the socket has been turned in a counter-clockwise direction to loosen the fastener.
Figure 8A:
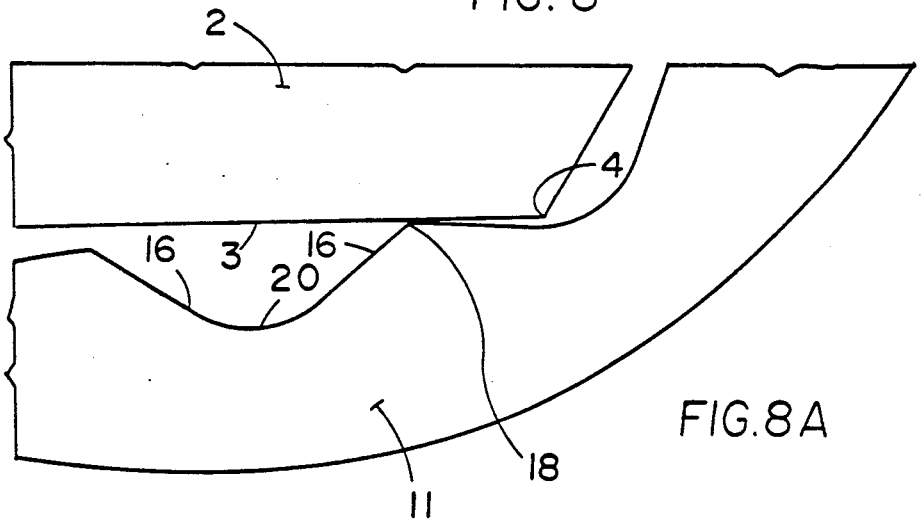
FIG. 8A is an enlarged view of the corner of the fastener of FIG. 8 in its relation to the socket of the present invention showing that the socket does not engage the corner of the fastener.

As illustrated in FIG. 3, the body 11 of the socket embodiment of the wrench 10 has a second end that has a square driver opening 21 formed therein through which the central axis 13 extends. This second end is located opposite to the one end in which the opening 12 is formed. The square driver opening 21 has recesses 22 formed therein on each of its sides to permit releasable securement of the wrench 10 by a conventional detent mechanism, such as a ball detent mechanism.

The six point wrench 10 of the present invention utilizes a substantially flat intermediate section 15 having an adjoining flank section 16 at either end of the intermediate section 15. The flank angle $\alpha$ formed between these two sections is dependent upon the size of the wrench 10, the flank angle $\alpha$ decreasing as the size of the fastener increase. The flank angle $\alpha$ is designed to ensure that the flank section 16 does not contact the corner 4 of the fastener 2. The design further ensures that the intersection 18 between the intermediate section 15 and the flank section 16 of the wrench 10 contacts the side 3 of the fastener 2 at the point which, based on the geometry of the wrench is fartherest away from the corner 4 of the fastener 2.

FIGS. 4–8A show the wrench 10 and fastener 2 in typical use in which the fastener 2 is disposed in the wrench 10 and in which the wrench 10 engages the fastener 2 in both a fastening and an unfastening mode. The enlarged views illustrate the initial engagement 18 between the respective face 3 of the fastener and the end of the flank section 16 of the wrench 10 showing the flank angle therebetween. These figures further illustrate that the wrench 10 does not engage the corners 4 of the fastener 2.

Figure 9:
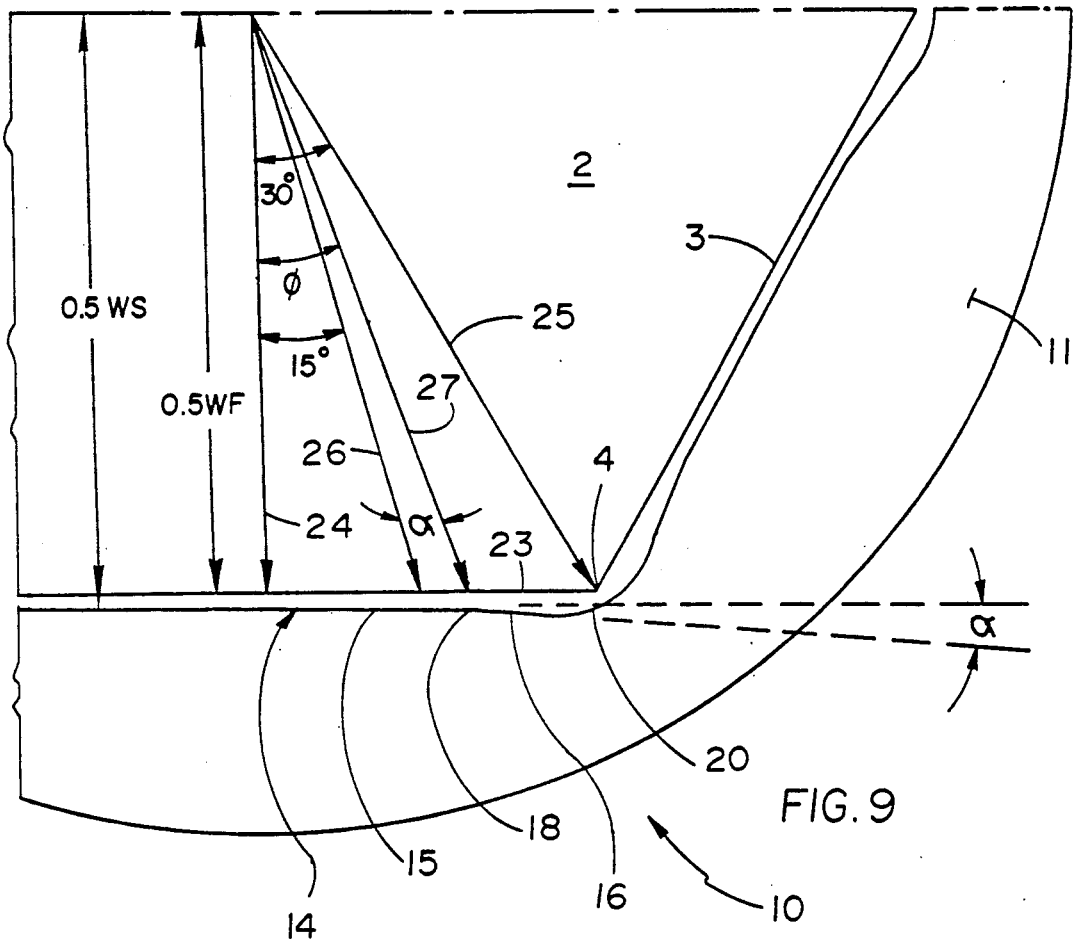
FIG. 9 is a partial view of the fastener in the socket embodiment of the present invention showing the radii of the fastener and the interception points of the radii on the respective face of the fastener with respect to the point of engagement of the fastener with the socket of the present invention.

Alternately, as shown in FIG. 9, this may be expressed in terms of the radii of the fastener 2. The first (minimum) radius 24 extends from the center of the fastener 2 to a point normal to the face 3 of the fastener 2. The maximum radius 25 extends from the center of the fastener 2 to the corner 4 of the fastener and is 30° from the minimum radius 24 since it intercepts one-half of the 60° segment of the hexagonal fastener 2. The present invention is so designed that a second (theoretical) radius 26, which bisects the angle between the maximum radius 25 and the minimum radius 26, intercepts the respective face 3 of the fastener 2 at a point which is opposed to the point on the wrench 10 at which the intermediate section 15 meets the flank section 16. This second radius 26 is at an angle of approximately 15° from both the maximum radius 26 and the first radius 24. When the wrench 10 is turned to engage the fastener 2, the point of engagement 18 on the fastener 2 is limited by a third (optimum) radius 27. This third radius 27 is larger than the second radius 26 and smaller than the maximum radius 25. It is at an angle from the minimum radius 24 which exceeds 15°. These dimensions are determined by the design of the present invention using the wrench 10 having the maximum tolerance dimensions (or a maximum socket width) and the fastener 2 having the minimum tolerance dimensions (or a minimum fastener width), which are the most severe conditions (i.e. maximum "free swing"). Mathematically this can be expressed as:

$$\text{flank angle } a = [\text{Arc Cos } (WF/WS \text{ Cos } 15°)] - 15°$$

Where WF = minimum fastener width
WS = maximum socket width

The following examples present the calculated values of angle $\alpha$ for a range of wrench sizes:

| Wrench size (in) | Min. Fastener = WF | Max. Wrench = WS | Angle | Min* | Max* |
|---|---|---|---|---|---|
| 5/16 | 0.307 | 0.322 | 7.93° | 8.0 | 9.0 |
| ⅜ | 0.370 | 0.384 | 6.45 | 6.5 | 7.5 |
| ½ | 0.495 | 0.510 | 5.36 | 5.5 | 6.5 |
| ¾ | 0.740 | 0.763 | 5.47 | 5.5 | 6.5 |
| 1⅛ | 1.115 | 1.142 | 4.42 | 4.5 | 5.5 |

*The actual values used for manufacturing purposes are within the tolerance limits of $\alpha$ Max. and $\alpha$ min. The values are rounded to a value greater than the calculated value to ensure that the initial point of engagement of the wrench is at a point on the face of the fastener between the intercepts of the second radius and the third radius of the fastener.

The flank angle $\alpha$ between the intermediate section 15 and flank section 16 is a value calculated to assure that under the most severe conditions of maximum wrench 10 dimensions and minimum fastener 2 dimensions, the corner 4 of the fastener 2 will not be in contact with the wrench 10. A theoretical value for the flank angle $\alpha$ is calculated and, if the angle is less than 0.5°, an additional amount is added so that the flank angle $\alpha$ will be at least 0.5°. In this manner, ease of manufacture is assured. With respect to the third radius 27 of the fastener 2, the angle $\phi$ between the third radius 27 and first radius 24 equals 15° plus the flank angle $\alpha$. The initial point of engagement on the wrench 10 is at the intersection 18 between the intermediate section 15 and the flank section !6. If the wrench 10 exactly fits the fastener 2 (a slip fit) the intersection 18 of the wrench contacts the respective face 3 of the fastener 2 at approximately the intercepting of the second radius 26 on the face 3 of the fastener 2 As the tolerance dimensions on the wrench 10 and the fastener 2 vary, the point of engagement between the wrench 10 and the fastener 2 is displaced in a direction toward the corner 4 of the fastener 2. However, due to the design herein of the wrench 10, the initial point of engagement is limited to a point on the respective face 3 of the fastener 2 which is substantially between the intercepting of the second radius 26 of the fastener and the intercepting of the third radius 27 of the fastener. This initial point of engagement is spaced from the adjacent corner 4 of the fastener 2 by an optimum distance 23. The initial point of engagement on the fastener 2 is as close as possible to the intercepting of he face 3 thereof by the second radius 26. The optimum distance 23 is a function of the size of the fastener 2 and the flank angle $\alpha$, and as such, varies for each size wrench 10.

Figure 14A:
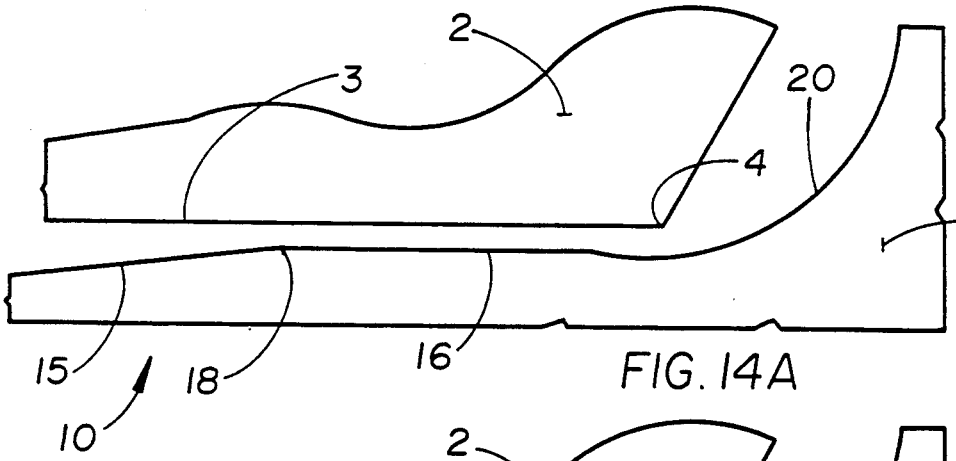
FIG. 14A–14D are enlarged views of the corner of the fastener in relation to the socket embodiment of the present invention showing the engagement of the fastener by the socket in the turning of the fastener wherein the fastener has a minimum width and the socket has a maximum width.
Figure 14B:
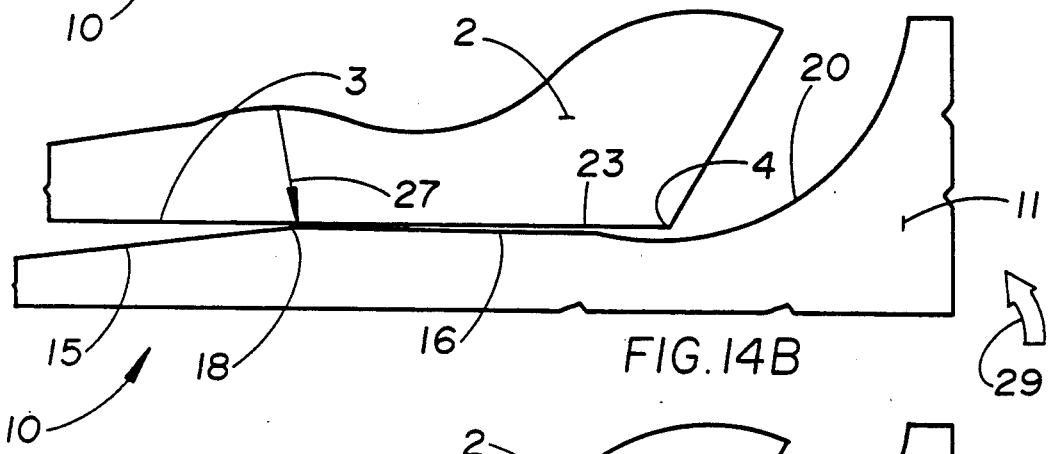
Figure 14C:
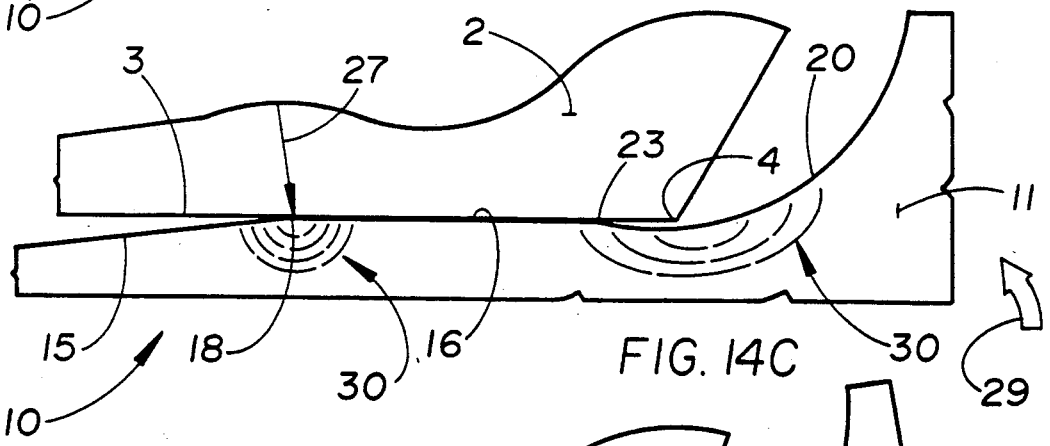
Figure 14D:
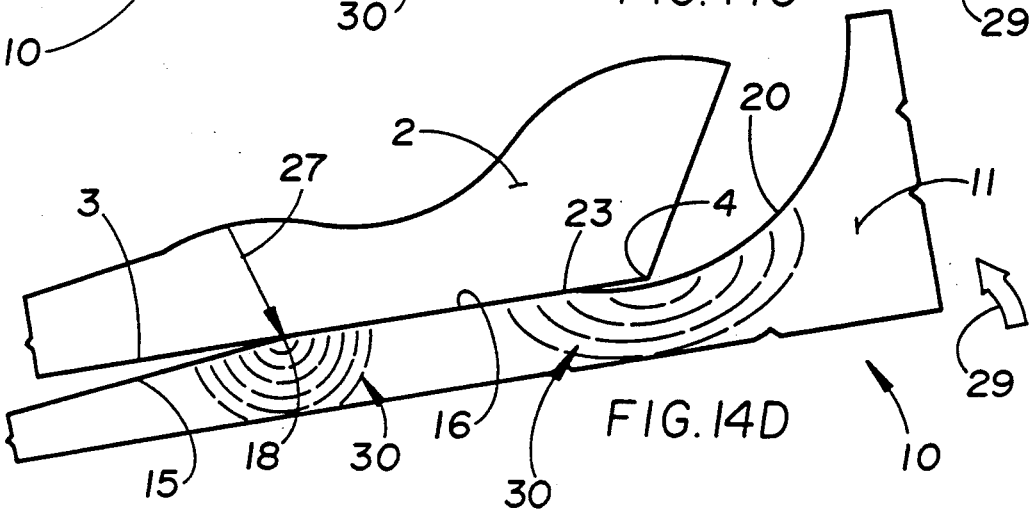

Referring now to FIGS. 14A–14D, the wrench (socket) 10 having a maximum width is fitted to the fastener having a minimum width 2 (FIG. 14A). In the example shown (FIG. 14B), the initial point of engagement at the intersection 18 of the intermediate section 15 and the flank section 16, coincides with the intercept of the face 3 of the fastener 2 by the third radius 27. This is the most extreme condition of maximum "free swing". As the wrench 10 is turned (arrow 29) to apply pressure against the fastener 2 (FIG. 14C) the walls of the wrench 10 are stressed and may flex. The flank section 16 approaches and contacts the face 3 of the fastener 2 to have an optimum drive condition between the flank section 16 of the wrench 10 and the face 3 of the fastener 3. Stress is produced in the wrench 10 as shown by stress lines 30. The length of the flank section 16 is smaller than the length of the optimum distance 23 on the face 3 of the fastener 2. Due to the arcuate relief of the connecting surface 20, the present wrench cannot engage the corner 4 of the fastener. As the fastener 2 turns (FIG. 14D), increased torque is applied and the wrench 10 continues to drive the fastener 2 by contact between the flank section 16 of the wrench 10 and the face 3 of the fastener 2.

Figure 15A:
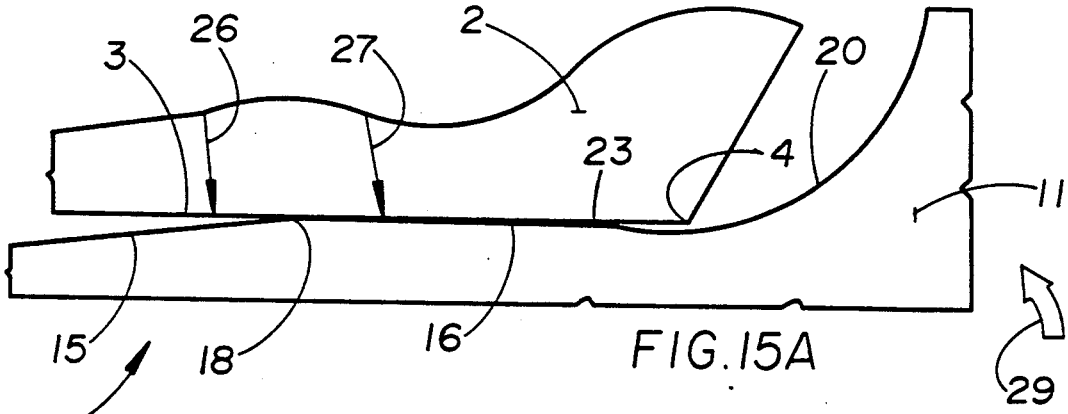
FIG. 15A–15C are enlarged views of the corner of the fastener in relation to the socket embodiment of the present invention showing the engagement of the fastener by the socket in the turning of the fastener wherein the fastener has a normal width and the socket has a normal width.
Figure 15B:
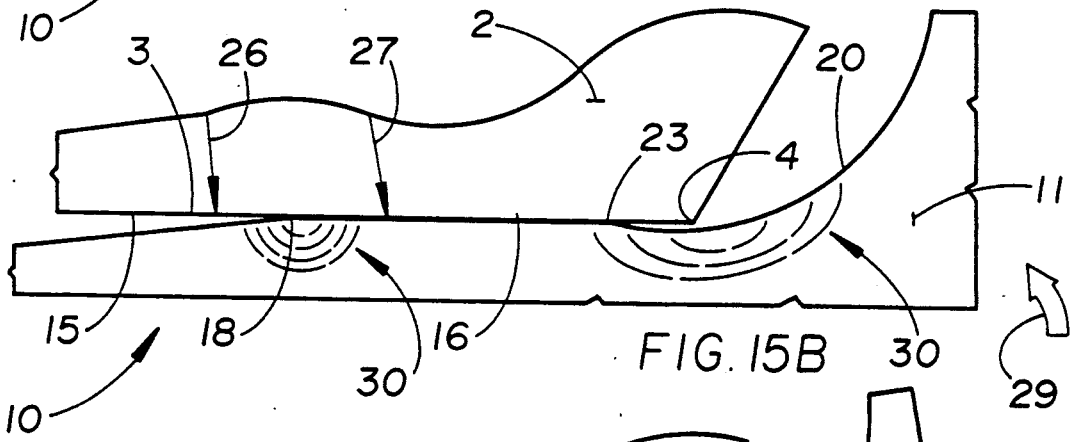
Figure 15C:
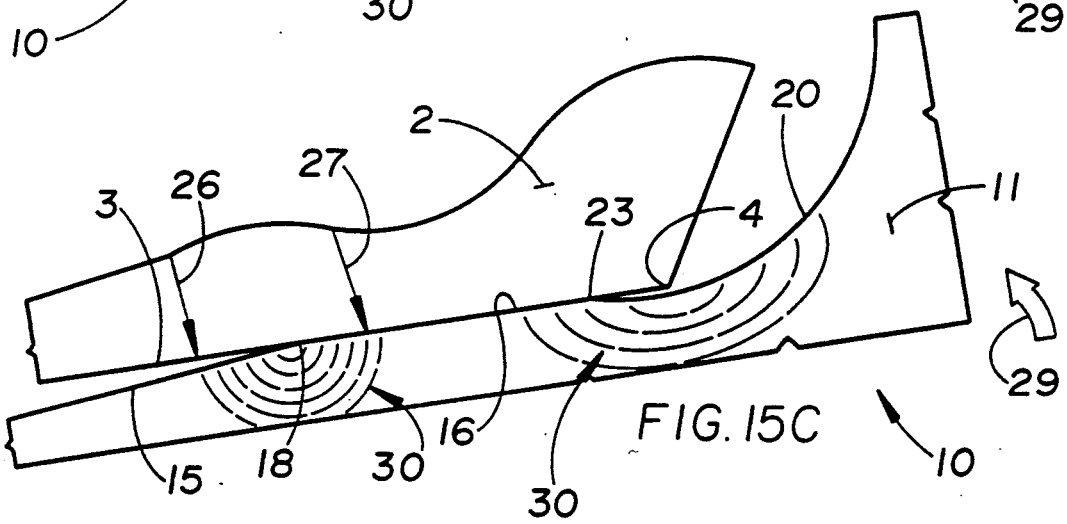

FIGS. 15A–15C represent the wrench (socket) 10 having a normal width and the fastener having a normal width. The initial point of engagement at the intersection 18 of the intermediate section 15 and the flank section 16, coincides with an intercept of the face 3 of the fasteners 2 at a point intermediate between the second radius 26 and the third radius 27. As the wrench (socket) 10 is turned, the walls of the wrench 10 are stressed and may flex. As discussed above, the corner 4 of the fastener 2 is not engaged by the wrench 10 of the present invention.

The twelve point coupling wrench 10, while not having an intermediate section 15, does have two intersecting flank sections 16 which form an edge portion in the wrench 10 with a flank angle $\alpha$ on either side of the edge portion to ensure that the flank section 16 does not contact the corner 4 of the fastener 2. The optimum distance 23 is measured as indicated with the six point wrench 10.

Formed as described above, the initial engagement 18 at the respective flank portion 16 of the wrench 10 always engage a respective face 3 of the fastener 2 at a point thereon which is spaced from the respective adjacent edge of the fastener 2 by a optimum distance 23.

The present invention thereby meets the rigid and critical aerospace industry requirements for wrenches.

It is noted that, while disclosed herein as a socket for use in a ratchet wrench, the wrench 10 could also be formed in a closed or open ended wrench that has a handle with at least one end including the opening 12 with a central axis 13 about which the wrench 10 is rotated. It is also possible to provide a double-ended wrench wherein a first end is of the open end wrench type and the second end is of the closed wrench type. In such a case, each wrench body 11 includes a wrench opening 12 with the engagement surfaces 14, including the flank portions 16 and the angled portions noted above. It should be appreciated that, as with the socket, the wrench opening of the closed end wrench may be of either the twelve-point construction or the hexagonal six-point construction.

The design of the present application provides improved contact between the socket and the fastener throughout the entire range of sizes, however, it is especially improved for smaller sizes such as $\frac{1}{4}$ inch through $\frac{3}{4}$ inch sockets.

A further advantage of the design of the present invention is that the socket can be made with minimum wall thickness because of the greater efficiency of torque transmission of the design. Additional wall thickness is not required to provide strength to the socket or wrench. This enables the user to have access to openings which have a smaller diameter so that the socket has a greater utility. Additionally, the thinner walls result in reduced weight of each socket and reduced manufacturing costs in production of the sockets. Also, the complicated relieved designs of the cited references are more costly to fabricate because the radius of the designs are difficult to control within tolerances.

Theoretically, the center lines of the wrench 10 and the fastener 2 are coincident and the socket 10 and fastener 2 are symmetrical about this center line. Actually, fasteners 2 are mass produced and may not be symmetrical. Also, both the fastener and the socket are made with allowable tolerances.

Figure 10:
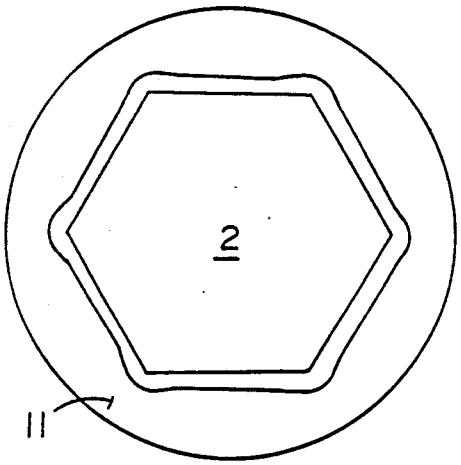
FIG. 10 is a top view of the socket embodiment of the present invention and a fastener showing the fastener having the minimum width and the socket having the maximum width which is not to scale in order to provide emphasis.
Figure 11:
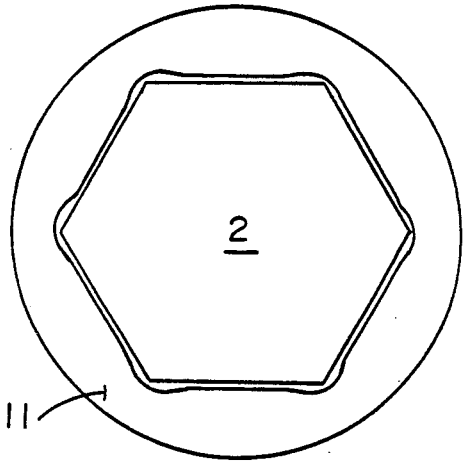
FIG. 11 is a top view of the socket embodiment of the present invention and a fastener showing the fastener having the maximum width and the socket having the minimum width.

Another feature of the present design is that it anticipates that all fasteners and all sockets are not ideal sizes and dimensional tolerances exist in both. Thus FIG. 10 shows a minimum width (WF) for the fastener 2 and a maximum width (WS) for the wrench 10. FIG. 10 is not drawn to scale in order to provide emphasis. FIG. 11 shows a maximum width for the fastener 2 and a minimum width for the wrench 10. Even under these extremes of condition, the design prevents engagement of the wrench 10 with the corners 4 of the fastener 2.

Figure 12:
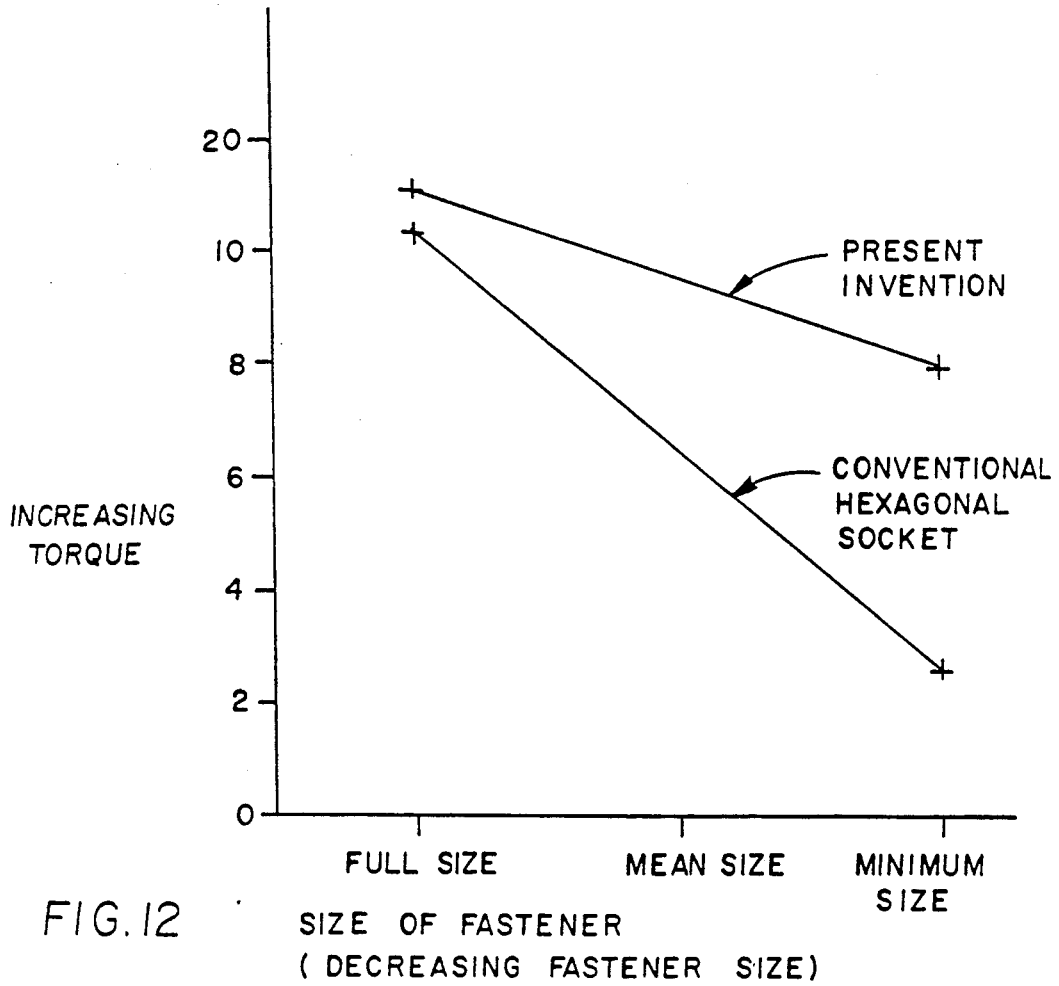
FIG. 12 is a graph showing the torque applied to the wrench to produce failure of the socket vs. the size of the fastener for a conventional socket compared to the socket of the present embodiment.

As an example of this, FIG. 12 illustrates the torque in inch pounds which can effectively be applied to a standard fastener having a nominal size 0.375 inches by the present invention and by a conventional hexagonal socket. Initially it should be noted that the standard fastener shows a distribution of sizes, the maximum being 0.375 inches across the flats with the majority being approximately 0.370 inches and some fasteners being 0.360 inches. In testing, one generally uses a hardened mandrel of the specific size and applies torque to the socket until failure of the socket occurs. As clearly shown in FIG. 12, as the fastener becomes smaller, significantly less torque is required t produce failure in the conventional hexagonal socket as compared to the torque required to result in failure to the socket of the present invention.

Figure 13:
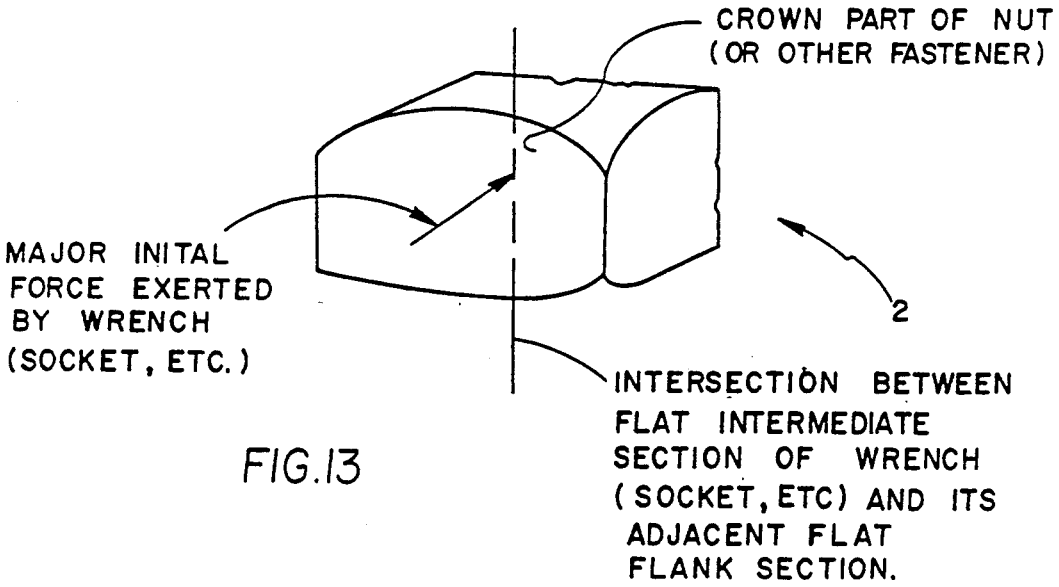
FIG. 13 is a perspective view of a fastener having a crown showing the increased surface of engagement with the wrench of the present invention.

Still another feature of the present invention results from the initial point of contact of the wrench 10 being at the intersection 18 of the intermediate portion 15 and the flank portion 16. Most fasteners 2 are not uniformly flat between corners 4 but are slightly crowned. Thus, as shown in FIG. 13, the wrench 10 engages the fastener 2 at a point in the crown of the fastener where there is a larger interface so that increased pressure is transmitted from the wrench 10 to the fastener 2.

While the best mode for carrying out the invention have been specifically disclosed, those familiar with the art to which this invention relates will recognize various alternative designs and embodiments for practicing the invention, as defined by the following claims.

What is claimed is:

1. In a wrench set, wherein a plurality of wrenches cooperate with a corresponding plurality of fasteners, wherein each fastener has a center and further has a plurality of faces joining each other at respective corners of the fastener, and wherein each fastener has a first radius extending from the center of the fastener to a point of intersection on the respective face normal to said face, and further has a second radius, larger than the first radius, extending from the center of the fastener and intercepting its respective face; the second radius being at an angle of approximately 15° from the first radius, each wrench having a plurality of adjoining surfaces cooperating with the respective faces of the fastener, each surface of the wrench including a substantially-flat intermediate section having a pair of ends, each surface of each wrench further including an adjoining flank section at each end of the intermediate section, each flank section being angled with respect to the intermediate section in a direction away from the fastener, thereby defining an intersection between the intermediate and flank sections, respectively and thereby defining a flank angle $\alpha$ between the flank and intermediate sections, respectively, the improvement wherein the fastener has a minimum width and the wrench has a maximum width, the flank angle being defined by $$\alpha = \left[\text{Arc Cos}\left(\frac{WF}{WS}\text{ Cos } 15^\circ\right)\right] - 15^\circ$$

in which:

$\alpha$=the flank angle

WF=minimum fastener width

WS=maximum wrench width and within a given range of fastener sizes, the flank angle decreases as the size of the fastener increases, such that each wrench substantially engages its cooperating respective fastener at an initial point of engagement, said initial point of engagement on the fastener being on the respective face of the fastener at a point on the face of the fastener which is substantially between the intercepting of the second radius and the intercepting of the second radius plus the flank angle, thereby assuring good torque engagement between the fastener and the wrench without marring the corners of the fastener, and thereby assuring good force distribution and the substantial elimination of stress concentrations on the wrench consonant with maximum wall thickness of the wrench, throughout the wrench set, and regardless of wrench dimensions and tolerances.

2. The improvement of claim 1, wherein each wrench includes an arcuate relief between respective flank sections at adjoining surfaces of the respective wrench.

3. The improvement of claim 1, wherein the wrench set comprises a plurality of sockets for a ratchet wrench.

4. The improvement of claim 1, wherein the wrench set comprises a plurality of closed end wrenches.

5. The improvement of claim 1, wherein the wrench set comprises a plurality of open end wrenches.

6. The improvement of claim 1, wherein the flank angle is at least 0.5°.

7. A wrench cooperating with a fastener, wherein the fastener has a center and further has a plurality of faces joining each other at respective corners of the fastener, and wherein the fastener has a first radius extending from the center of the fastener to a point of intersection on the respective face normal to said face, a second radius, larger than the first radius, extending from the center of the fastener and intercepting the respective face of the fastener, the second radius being at an angle of approximately 15° from the first radius and a third radius; the third radius extending from the center of the fastener and intercepting the respective face of the fastener, the third radius being larger than the second radius, being at an angle of approximately 15° plus a flank angle from the first radius; the wrench comprising, in combination, a plurality of adjoining surfaces cooperating with the respective faces of the fastener, each surface of the wrench including a substantially-flat intermediate section having a pair of ends, each surface of the wrench further including an adjoining flank section at each end of the intermediate section, each flank section being angled with respect to the intermediate section in a direction away from the fastener, thereby defining the flank angle $\alpha$ between the flank and intermediate sections, respectively, wherein the fastener has a minimum width and the wrench has a maximum width, the flank angle being defined by $$\alpha = \left[\text{Arc Cos}\left(\frac{WF}{WS}\text{ Cos } 15^\circ\right)\right] - 15^\circ$$

in which:

$\alpha$=the flank angle

WF=minimum fastener width

WS=maximum wrench width and wherein the end of the intermediate section of each wrench surface at the respective flank section thereof has a point of engagement with the respective face of the fastener at a point on the face of the fastener which is substantially between the intercepting of the second radius of the fastener and the intercepting of the third radius of the fastener with the respective face thereof, which point of engagement is spaced from the respective adjacent corner of the fastener by an optimum distance, thereby assuring good torque engagement between the fastener and the wrench without marring the corners of the fastener.

8. The wrench of claim 7, wherein the flank angle is at least 0.5°.

9. A wrench cooperating with a fastener, wherein the fastener has a center and further has a plurality of faces joining each other at respective corners of the fastener, and wherein the fastener has a first radius extending from the center of the fastener to a point on the respective face of the fastener such that the first radius is normal to the respective face of the fastener; a second radius, larger than the first radius, extending from the center of the fastener and intercepting the respective face of the fastener, the second radius being at an angle of approximately 15° from the first radius, and a third radius, the third radius extending from the center of the fastener and intercepting the respective face of the fastener, the third radius being larger than the second radius, being at an angle of approximately 15° plus a flank angle from the first radius; the wrench comprising, in combination a plurality of adjoining surfaces cooperating with the respective faces of the fastener, each surface of the wrench having a pair of adjoining flank sections forming an edge portion on the wrench, each flank section being angled with respect to the edge portion on the wrench in a direction away from the fastener, thereby defining the flank angle $\alpha$ between the flank and edge portion, respectively, wherein the fastener has a minimum width and the wrench has a maximum width, the flank angle being defined by $$\alpha = \left[\text{Arc Cos}\left(\frac{WF}{WS}\text{ Cos } 15^\circ\right)\right] - 15^\circ$$

in which $\alpha$=the flank angle

WF=minimum fastener width

WS=maximum wrench width and wherein the edge portion of each wrench surface at the respective flank section thereof has a point of engagement with the respective face of the fastener at a point on the face of the fastener which is substantially between the intercepting of the second radius of the fastener and the intercepting of the third radius of the fastener with the respective face thereof, which point of engagement is spaced from the respective adjacent corner of the fastener by an optimum distance, thereby assuring good torque engagement between the fastener by an optimum distance, thereby assuring good torque engagement between the fastener and the wrench without marring the corners of the fastener.

10. A set of wrenches sized to fit a range of fasteners, wherein each fastener has a center and each fastener further has a plurality of faces joining each other at respective corners of the respective fastener, and wherein each fastener has a first radius extending from the center of the fastener to a point on the respective face of the respective fastener such that the first radius is normal to the respective face of the respective fastener, a second radius, larger than the first radius, extending from the center of the fastener and intercepting the respective face of the respective fastener, the second radius being at an angle of approximately 15° from the first radius, and a third radius extending from the center of the respective fastener and intercepting the respective face of the respective fastener, the third radius being larger than the second radius being at an angle of approximately 15° plus a flank angle $\alpha$ from the first radius; each wrench of the set comprising, in combination, a plurality of adjoining surfaces cooperating with the respective faces of the respective fastener, each surface of each wrench including an intermediate section having a pair of ends, each surface of each wrench further including an adjoining flank section at each end of the intermediate section, each flank section being angled with respect to the intermediate section in a direction away form the respective fastener, thereby defining the flank angle $\alpha$ between the flank section and the intermediate section, wherein the fastener has a minimum width and the wrench has a maximum width, the flank angle being defined by $$\alpha = \left[\text{Arc Cos}\left(\frac{WF}{WS}\text{ Cos } 15^\circ\right)\right] - 15^\circ$$

in which:

$\alpha$=the flank angle

WF=minimum fastener width

WS=maximum wrench width wherein the end of each of the intermediate sections at the respective flank sections thereof has a point of engagement with the respective face of the respective fastener at a point on the face of the respective fastener which is substantially between the intercepting of the second radius of the respective fastener and the intercepting of the third radius of the respective fastener with the respective face thereof, which point of engagement is spaced from the respective adjacent corner of the respective fastener by an optimum distance; wherein, for the given range of fastener sizes, the flank angle decreases as the size of the fastener increases; and wherein each wrench includes an arcuate relief between respective flank sections at adjoining surfaces of the respective wrench.

11. A set of wrenches sized to fit a range of fasteners, wherein each fastener has a center and each fastener further has a plurality of faces joining each other at respective corners of the respective fastener, and wherein each fastener has a first radius extending from the center of the fastener of a point on the respective face of the respective fastener such that the first radius is normal to the respective face of the respective fastener, a second radius, larger than the first radius, extending from the center of the fastener and intercepting the respective face of the respective fastener, the second radius being at an angle of approximately 15° from the first radius, and a third radius extending from the center of the respective fastener and intercepting the respective face of the respective fastener, the third radius being larger than the second radius being at an angle of approximately 15° plus a flank angle $\alpha$ from the first radius; each wrench of the set comprising, in combination a plurality of adjoining surfaces cooperating with the respective faces of the respective fastener, each surface of each wrench including an intermediate section having a pair of ends, each surface of each wrench having a pair of adjoining flank sections forming an edge portion on the respective wrench, each flank section being angled with respect to the edge portion respectively, thereby defining the flank angle $\alpha$ between the flank section and the intermediate section, wherein the fastener has a minimum width and the wrench has a maximum width, the flank angle being defined by $$\alpha = \left[ \text{Arc Cos} \left( \frac{WF}{WS} \text{Cos } 15^\circ \right) \right] - 15^\circ$$

in which:

$\alpha$=the flank angle

WF=minimum fastener width

WS=maximum wrench width wherein the edge portion of each wrench surface at the respective flank section thereof has a point of engagement with the respective face of the respective fastener at a point on the face of the respective fastener which is substantially between the intercepting of the second radius of the respective fastener and the intercepting of the third radius of the respective fastener with the respective face thereof, which point of engagement is spaced from the respective adjacent corner of the respective fastener by an optimum distance; wherein, for the given range of fastener sizes, the flank angle decreases as the size of the fastener increases; and wherein each wrench includes an arcuate relief between respective flank sections at adjoining surfaces of the respective wrench.

12. A wrench cooperating with a fastener, wherein the fastener has a plurality of faces joining each other at respective corners of the fastener, the wrench comprising, in combination, a plurality of adjoining surfaces cooperating with the respective faces of the fastener, each surface of the wrench including a substantially-flat intermediate section having a pair of ends, each surface of the wrench further including an adjoining flank section at each end of the intermediate section, each flank section being angled with respect to the intermediate section in a direction away from the fastener, thereby defining a flank angle $\alpha$ between the flank and intermediate sections, respectively, and wherein the fastener has a minimum width and the wrench has a maximum width, the flank angle being defined by $$\alpha = \left[ \text{Arc Cos} \left( \frac{WF}{WS} \text{Cos } 15^\circ \right) \right] - 15^\circ$$

in which:

$\alpha$=the flank angle

WF=minimum fastener width

WS=maximum wrench width.

* * * * *